US006601869B2

(12) United States Patent
Porchéron

(10) Patent No.: US 6,601,869 B2
(45) Date of Patent: Aug. 5, 2003

(54) BODY SUPPORT DEVICE FOR A STAND-UP WHEELCHAIR AND WHEELCHAIR FOR SAID DEVICE

(75) Inventor: François Porchéron, Lyons (FR)

(73) Assignee: IDC Medical, Beynost Cedex (FR)

( * ) Notice: Subject to any disclaimer, the term of this patent is extended or adjusted under 35 U.S.C. 154(b) by 0 days.

(21) Appl. No.: 09/946,455

(22) Filed: Sep. 6, 2001

(65) Prior Publication Data

US 2002/0027334 A1 Mar. 7, 2002

(30) Foreign Application Priority Data

Sep. 7, 2000 (FR) ..... 00 11415

(51) Int. Cl.[7] ..... A61G 5/14
(52) U.S. Cl. ..... 280/648; 280/250.1; 297/423.12
(58) Field of Search ..... 280/250.1, 304.1, 280/647, 648; 5/83.1, 86.1; 297/432.11, 423.12, 432.17, 423.11, DIG. 10

(56) References Cited

U.S. PATENT DOCUMENTS

| | | | | | |
|---|---|---|---|---|---|
| 4,456,086 | A | * | 6/1984 | Wier et al. | 180/11 |
| 4,704,749 | A | * | 11/1987 | Aubert | 5/87.1 |
| 5,096,008 | A | * | 3/1992 | Mankowski | 180/6.5 |
| 5,489,258 | A | * | 2/1996 | Wohnsen et al. | 602/5 |
| 5,556,121 | A | * | 9/1996 | Pillot | 280/304.1 |
| 6,125,957 | A | * | 10/2000 | Kauffmann | 180/65.1 |

* cited by examiner

*Primary Examiner*—Kevin Hurley
(74) *Attorney, Agent, or Firm*—Dennison, Schultz & Dougherty

(57) ABSTRACT

A body support device adaptable on a wheelchair and having a pair of stockings, wherein each of the pair of stockings comprises a cradle having a generally concave surface for nesting the legs of a user, a support having a frontal arm, each of the stocking cradles being mounted on the support, wherein the support is articulated on a lateral pivot with vertical orientation adapted on the foot rest, and a locking device linking the pair of stockings.

20 Claims, 4 Drawing Sheets

BODY SUPPORT DEVICE FOR A STAND-UP WHEELCHAIR AND WHEELCHAIR FOR SAID DEVICE

The present invention concerns chairs used by handicapped persons and invalids and can be used as collapsible or not collapsible wheelchairs.

The object of the invention more particularly concerns wheelchairs of the type including an articulated structure including a back portion, a seat and a foot rest associated with a motor element for assisting or controlling the lifting or lowering of the articulated structure with respect to the carrying chassis.

These wheelchairs undeniably represent a genuine progress as, in addition to essential mobility, they enable the occupant to stand up which is also essential so as to avoid the physical tiredness resulting from said occupant remaining seated for too long.

The prior art proposes a certain number of solutions to embody wheelchairs comprising a stand-up articulated structure.

These various proposals have advantages and drawbacks, but generally enable an occupant to stand up correctly, at least partially. However, it has been observed that these wheelchairs could not be used by all handicapped persons or invalids. Indeed, for certain handicaps or invalids, the occupant does not or no longer has sufficient muscular control to remain in a stable position against the stand-up support plan exhibited by the raised articulated structure of a wheelchair.

In these cases, the stand-up position presents a real danger for the occupant who, in the absence of self control, may fall by being moved sideways or by bending his legs or even by the collapse of his trunk.

Now, the ability of remaining upright is important for all handicapped persons or invalids and perhaps even more so for those not possessing any physical control as in the cases mentioned above.

So as to resolve this problem, it has been proposed, specifically by the patent FR83-08201, to adapt on said wheelchairs a body support device including:

- a first set of means comprising two rigid segments in the bent portion, each mounted sideways on the corresponding upright of the back portion by a articulated system and able to be placed:
  - along a generally vertical orientation in which they represent rail armrests for an occupant,
  - or along a generally horizontal orientation in which they constitute a thoracic strap for the occupant,
- and a second set of means comprising two cradles mounted by hinge pins on the front uprights of the foot rest unit, said cradles being associated with relative immobilisation means in an alignment position in which they constitute open elastic stockings nesting via the front the legs of an occupant.

The above means need to be considered as able to mainly satisfy the problem of standing up and supporting the occupant in the raising and lowering phases of the articulated structure so that the body of said occupant is appropriately supported in safety.

The backward movement now available concerning the use of these stand-up wheelchairs has nevertheless proved it is necessary to improve certain technical means implemented to ensure body support and more specifically the technical means relating to the second set intended for locking by the bending of the lower limbs of the occupant by immobilising the legs immediately below the joint of the knees.

Indeed, it has been observed that it is precisely at these locations that the immobilisation constraints are the most concentrated and that these constraints are connected with the frequency and period of standing up, but also with the height and weight of the occupant.

For remaining stood up for a relatively long period without any intermediate phases in which the occupant remains in a seated position for relatively long periods, the appearance of traumatism, indeed bed sores, have been observed causing either pain or local discomfort to the occupant.

Thus, there is a need to be able to resolve this drawback.

It has also been shown that the body support means used in relation with the lower limbs offers no possibility of nesting adjustment and may thus be regarded as ill-adapted to the differences and variations of anatomic configuration exhibited by handicapped persons.

It has thus been demonstrated the necessity to satisfy a further requirement. In addition, it has also been shown that the technical means implemented to constitute the body support device with respect to the lower limbs could only slightly, if at all, adjust in a spatial position the means for nesting the lower limbs and would moreover oblige the handicapped person to carry out slight ergonomic opening and closing manoeuvres.

Thus, it has been revealed that there exists a third problem which needs to be solved so as to satisfy the comfort for handicapped person using a stand-up wheelchair.

Therefore, the object of the invention to satisfy the needs mentioned above is to implement technical means characterised by the fact that said means are combined to form a functional combination to satisfy all three requirements at the same time. So as to reach this objective, the body support device of the invention, able to be adapted on a wheelchair including a chassis supporting an articulated stand-up structure composed of a seat, a back portion and a foot rest, said device including two elastic stockings constituted by two cradles borne by articulated supports on the foot rest and linking between the elastic stockings by a locking system, is characterised in that each cradle arch has a surface with a generally concave shape for nesting the legs and is mounted adjustable on the frontal arm of a member constituting the support and which is mounted pivoting by an arm with vertical orientation on a lateral pivot exhibited by the footrest.

Other characteristics shall be described hereafter with reference to the accompanying drawings which show by way of non restrictive examples the embodiments and implementations of the object of the invention.

Figure 1:
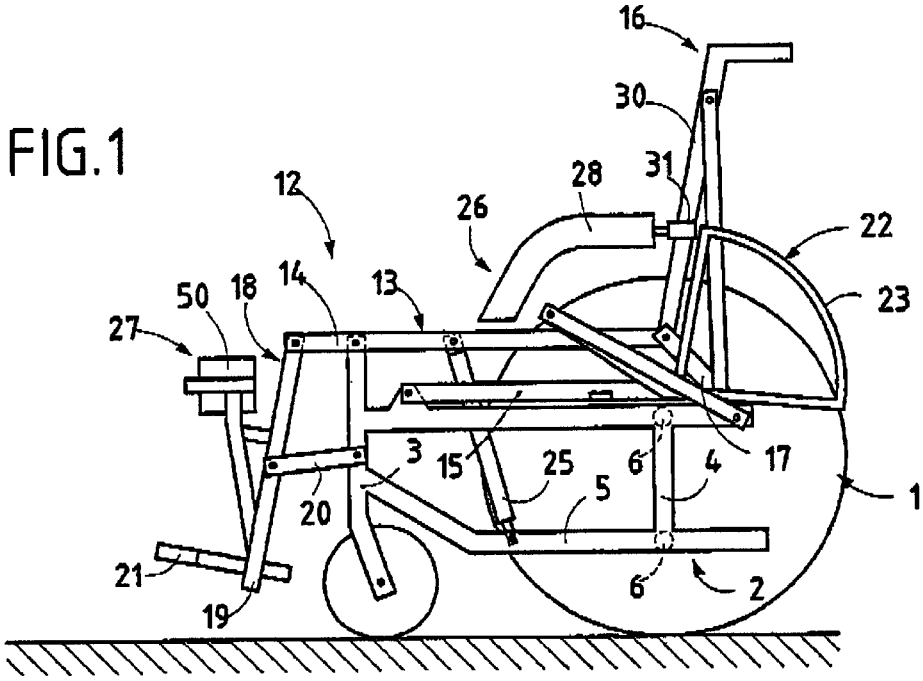
FIGS. 1 and 2 are diagrammatic views of a wheelchair including a stand-up articulated structure and illustrating the body support device of the invention.
Figure 2:
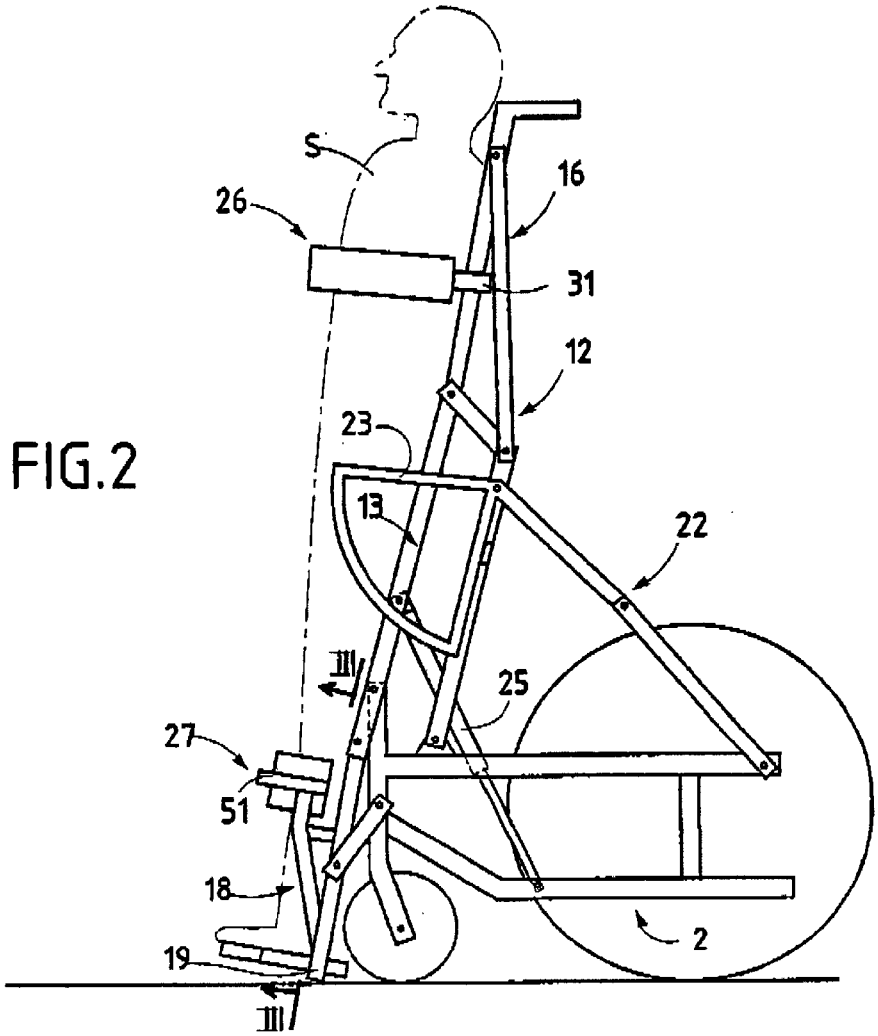

So as to readily understand the object of the invention, FIGS. 1 and 2 diagrammatically refer to wheelchair 1 which may be collapsible including a chassis 2 constituted by front 3 and rear 4 uprights joined together by longitudinal girders 5 and crossmembers 6.

The chassis 2 is equipped with a lifting articulated structure 12 enabling an occupant S to stand up. Said structure 12 generally includes a seat 13 composed of longitudinal girders 14 and 15 joined to the front portion of the chassis 2. The structure 12 further includes a back portion 16 jointed on the longitudinal girders 14 and 15, for example by means of rocker bars 17. The articulated structure 12 is completed by foot rest assembly 18 including two front uprights 19 joined on the longitudinal girders 14 and on the uprights 3 of the chassis 2 by two rocker bars 20. The assembly 18 supports one or two foot rests 21 in a known fashion. The articulated structure 12 is connected to the chassis 2 by two manoeuvre assemblies 22 for immobilising by geometrical locking the articulated structure 12 in a seated stable position according to FIG. 1 or in a raised stable position according to FIG. 2. The manoeuvre assemblies 22 are completed by at least one motor element 25, such as a spring or gas thrustor, inserted between the chassis 2 and for example the seat 13.

FIG. 2 shows the articulation relation existing between the seat, the back portion and the foot rest assembly 18 stressed on moving upward by the manoeuvre assemblies 22 and the motor element(s) 25.

So as to ensure the body support of an occupant S, as shown by dot-and-dash lines, brought into a standing-up position following lifting of the articulated structure 12, a device is provided to make up for the lack or absence of physical control of the occupant S so as to be safely supported in the stable sanding-up position. Said body supporting device includes a first set of means 26 intended to be adapted on the back portion, and a second set of means 27 intended to be adapted on the foot rest assemblies 18.

The first set of means 26 includes two segments 28 mounted on the corresponding uprights 30 of the back portion by a articulated system 31. By means of this system, the two segments can be placed inside two lateral vertical planes so as to play the role of two rail armrests (FIG. 1), or inside an approximately horizontal plane (FIG. 2) to play the role of a thoracic belt encompassing the chest of the occupant S placed in a stand-up position.

Figure 3:
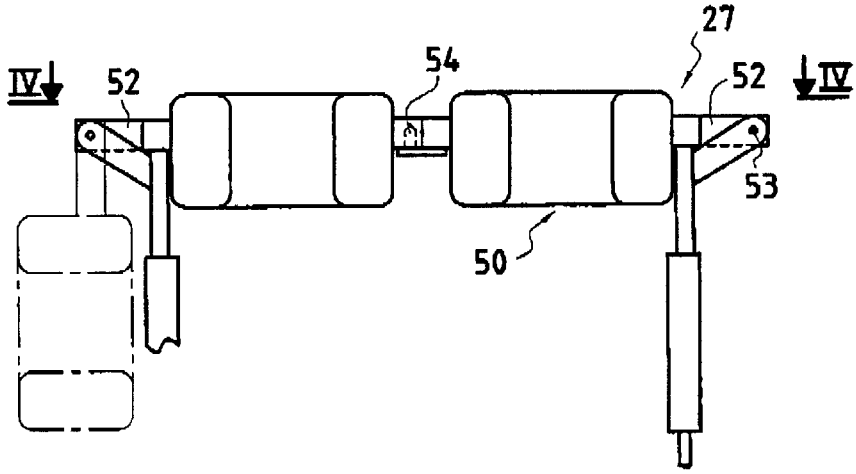
FIG. 3 is a bird's eye view on a larger scale taken along the line III—III of FIG. 2.
Figure 4:
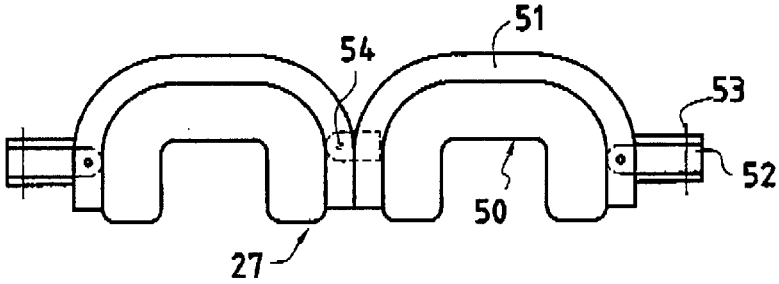
FIG. 4 is a view taken along the line IV—IV of the FIG. 3.

The second set of means 27 includes two open elastic stockings 50 for nesting via the front the legs of an occupant so as to take support slightly below the tibial plate so as to immobilise the lower limbs laterally and inside the antero-posterior plane. In order to achieve this, each half elastic stocking includes a cradle 51 borne by a support 52 joined by a horizontal spindle 53 to the front of the front upright 19 (FIGS. 3 and 4). In this way, the elastic stockings can occupy an idle position shown by the dot-and-dash lines on FIG. 3, or a functional position by being aligned and immobilised by a locking device 54 and in which they nest the legs of the occupant S so as to form frontal stops preventing the legs of the occupant from bending.

Figure 5:
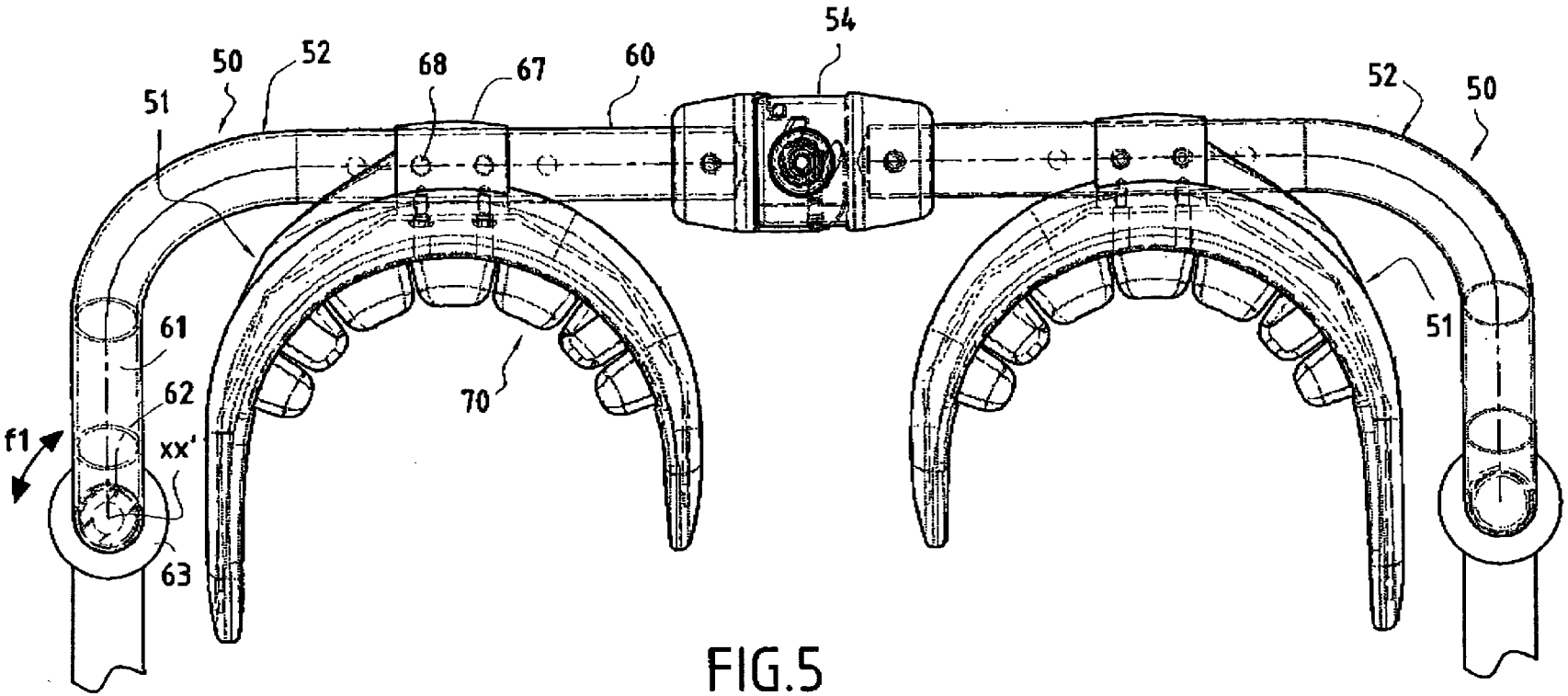
FIG. 5 is a bird's eye view similar to FIG. 4, but illustrating more specifically the object of the invention.
Figure 6:
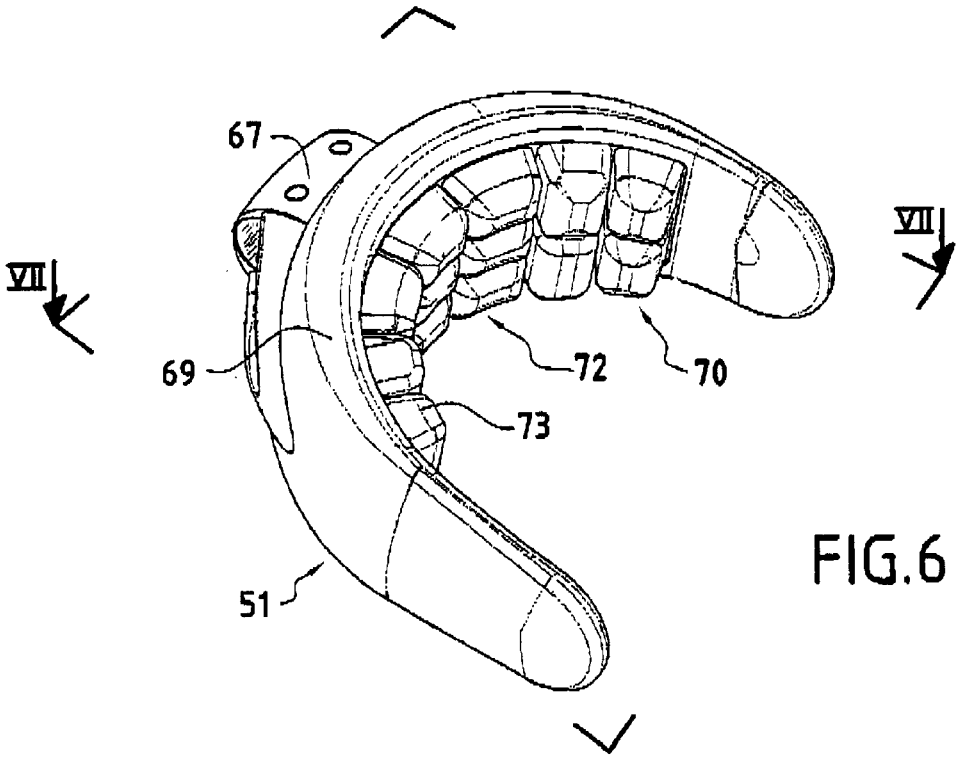
FIG. 6 is a perspective view showing on larger scale one of the elements constituting the body support device.

So as to improve the functionality of the second set of means 27, the improvements of the invention make use of the following means. First each elastic stocking 50 includes a cradle 51 mounted on a support 52 embodied in the form of a member including a frontal arm 60, an intermediate portion 61 and an arm 62 with a general vertical orientation intended to co-operate with a pivot 63 with a vertical general axis X–X', borne, mounted, formed or otherwise constituted by the foot rest 18 and for example in relation with the corresponding upright 19 of the latter. Preferably, the association of the pivoting arm 62 with the pivot 63 is effected by a vertically telescopic engaging which offers the possibility of removing the frame 52 via vertical extraction and reconfiguration via a reverse movement. In addition, the association of the pivoting arm 62 with the pivot 63 allows the frame 52 to be pivoted in the two directions of the arrow $f_1$ between two extreme positions in one of which, as shown on FIG. 5, the frontal arms 60 of the two half elastic stockings are aligned by being united by the locking device 54, and in the other by pivoting for example over an angular range of 90°, the frontal arm 60, following opening of the locking device 54, is found orientated outwardly and parallel to the pivot 23 in an opening position.

Said two extreme positions correspond, as regards the first, to the body supporting position in which the cradles 51 nest the lower limbs of the occupant S as shown on FIG. 2, and as regards the second, to an opening position occupying in a lowered position of the articulated structure 12 so as to favour freeing of the lower limbs of the occupant and thus helping him to get out of the wheelchair. It needs to be considered that, although not shown, said two extreme positions can, if appropriate for at least one of them corresponding to the opening position, be determined by indexing or stop means, thus limiting the range of angular movement along the arrow $f_1$.

The above implemented means contribute in offering the occupant or user comfort in using the wheelchair by facilitating manoeuvres for opening and closing the half elastic stockings 50.

Figure 7:
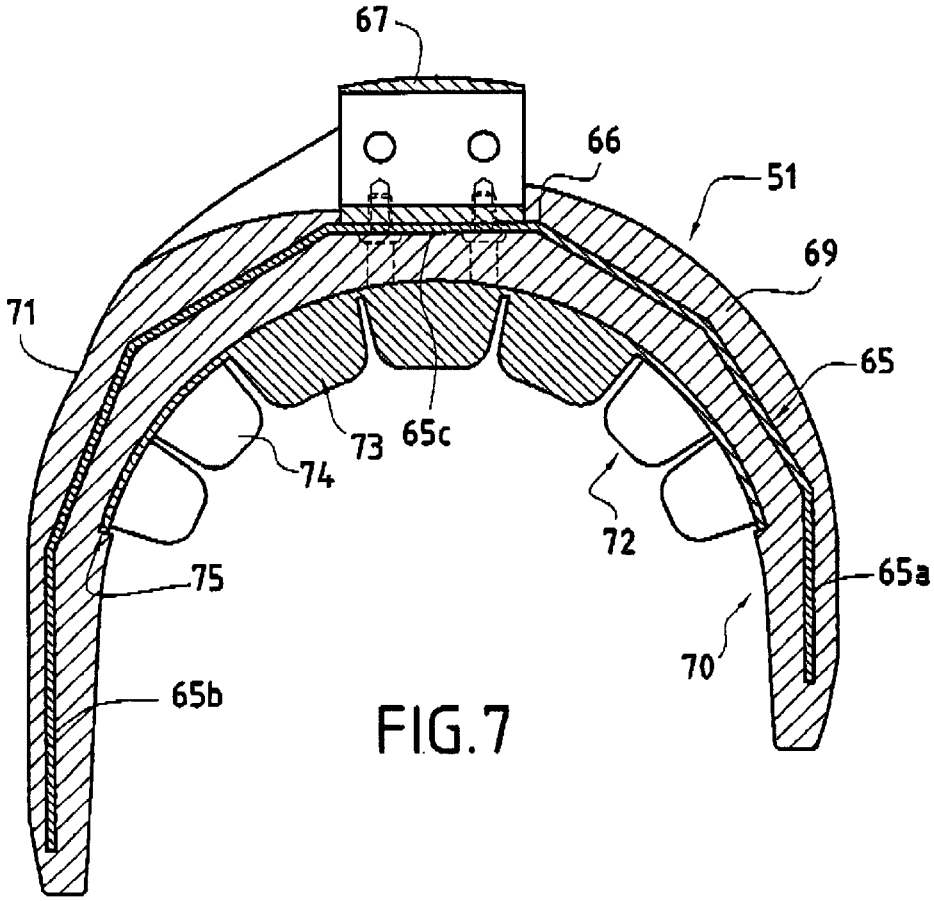
FIG. 7 is a cutaway view taken approximately along the plane VII—VII of the FIG. 6.

According to a further constructive arrangement of the invention, each cradle 51 is constituted by a reinforcement 65 embodied in the form of a blade having an adapted mechanical resistance whilst at the same time offering a possibility of warping by winding and unwinding relative to its length which is greater with respect to its width. The blade 65, more specifically shown on FIG. 7, is for example made of ductile steel or even a material with a memory effect. By deformation capacity by winding and unwinding, it should be considered that the stress needing to be or able to be applied to obtain such a result can be that developed manually by a human being so as to offer the choice of an opening in correspondence with the nesting needing to be made with respect to the lower limbs of the handicapped person.

The blade 65 may here have a continuous shape, on the contrary, having been submitted to die stamping or camber operations and able to comprise open folds 66 constituting preferential deformation zones at the level of which opening or closing can take place by means of traction or compression on the end portions 65*a* and 65B of the blade 65. It should be considered in the meaning of the invention that in other cases the blade 65 could be embodied in the form of a sandwich type composition including layers of materials able to satisfy the same characteristics.

The reinforcement 65 is associated, in its approximately central portion 65*c*, with an assembling sleeve 67 which is preformed so as to be adapted on the frontal arm 60 of the member 52. Technical means are implemented to enable axial immobilisation in the adapted position of the sleeve 67 on the arm 60, as well an angular immobilisation on said arm. In the case where the member 52 is constituted by a tube, the axial and angular immobilisation means may be constituted by needle screws or the like 68 which may, if appropriate, be replaced by open extreme segments constituting clamps via association with clamping elements.

It should be admitted that according to the invention the complementarity between the assembling sleeve 67 and the frontal arm 60 may, if appropriate, make use of a polygonal configuration at the right cross section, for example hexagonal. Each blade 65 is buried in a coating 69 which is, for example, embodied by duplicate moulding so as to give the shape of the cradle 51 and delimit, by means of an internal surface area 70 able to be qualified as approximately concave, a configuration for nesting the lower limbs of the occupant S and more particularly of the proximal portion of the legs situated below the knees. The coating 69 is selected from a base material allowing elastic deformation with damping and pressure distribution so as to reduce, if not suppress, the risk of traumatism and bed sores. With this aim in view, the coating 69 may be a homogeneous single constituent or a heterogeneous multi-constituent. In this case, the constituents are selected so that they have different resistances to deformation, the less resistant constituent contributing in defining the nesting surface 70. In both the above cases, the coating 69, which may be an alveolar-based material with open or close cells, is completed by at least one contact skin 71 for the nesting surface 70.

Figure 8:
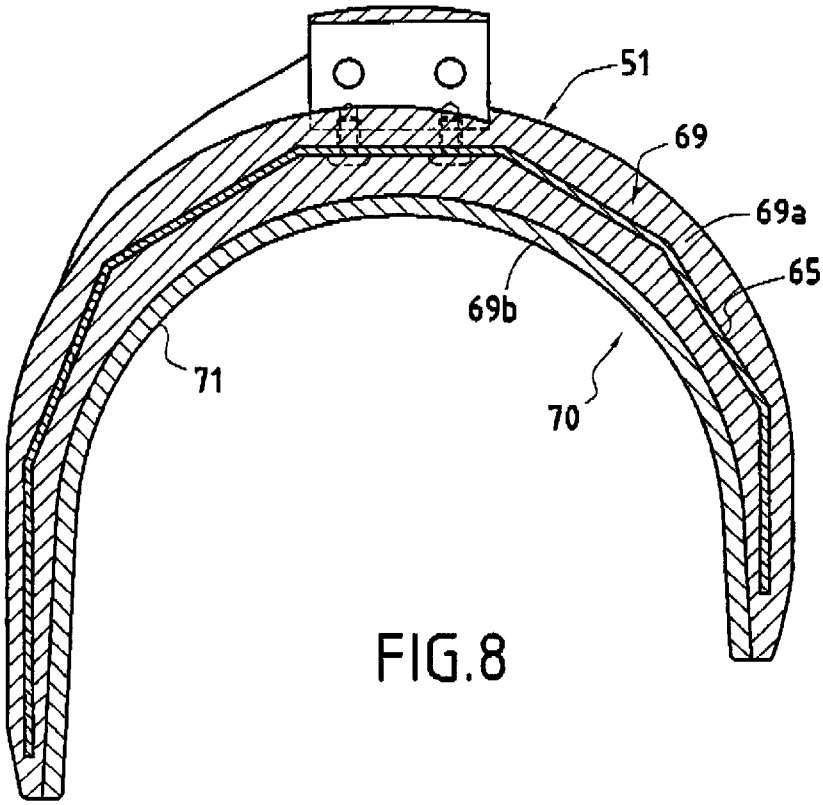
FIG. 8 is a cutaway view similar to FIG. 7 but illustrating more diagrammatically on a different scale an embodiment variant.

FIG. 8 illustrates such an embodiment in which the skin 71 fully covers the coating 69 which includes a first coat 69*a* directly covering the reinforcement 65, and a second coat 69*b* which covers the internal face of the coating 69 which defines the nesting surface 70. In this case, the coat 69*b* corresponds to that with the lowest resistance to deformation.

In a more elaborate embodiment variant, the nesting face 70, at least in the zone defined between the end portions 65*a* and 65*b*, is provided with a sort of bearing 72 defining blocks or stoppers 73, which via their truncated top in some way delimits the actual nesting surface 70 and whose function is to ensure contact damping and pressure distribution, and in particular avoid bed sores.

This function is provided by the shape of the blocks or stoppers which are partially separated from one another so as to define air circulation channels aiding contact comfort. In such a case, the bearing 72 is basically made, at least partly, of material having lower resistance to deformation and may comprise also preferably a contact and comfort skin 74.

The bearing 72 may form an integral part of the cradle by being integral with the coating 69. However, in a preferred embodiment the bearing 72 is constituted by an independent element which is attached, mounted or adapted in an additional housing 75 provided by the internal surface area and approximately concave 70 and delimited by the coating 69.

In an advantageous development, the bearing 72 is mounted so as to be able to detached inside the housing 75, for example with the aid of layers of adhesive products or else by the contact gripping liaison systems, such as those commercially known and sold under the VELCRO trademark.

The bearing 72 may be basically embodied from any material adapted so as to assume the function of providing contact and comfort to the lower members and therefore it can be retained to constitute said bearing in the form of a casing defining the skin 74 and delimiting the kind of alveoles filled with a suitable gel so as to contribute in the presence and formation of the blocks or stoppers 73.

By the above means, each cradle can be adapted to correspond to the anatomic configuration of the lower limbs since it merely needs to bring closer or move away the end parts 65*a* and 65*b* to enable the cradle and its lining formed by the coating 69 and/or the bearing 72 to delimit or define an adapted nesting surface area 70.

Furthermore, the choice of a coating locally having resistance to different deformations, as well as the orientation of the material offering lower resistance with respect to the nesting surface, makes it possible to embody a surface contact not stressing with the lower limbs and limit, indeed eliminate, the risks of friction, redness, traumatisms or bed sores which generally occur in cases of intensive use of a stand-up wheelchair.

Said advantage is certainly preferably obtained by means of the presence of a bearing 72 whose movable adaptation offers a possible choice for additional comfort, as well as the ability to be repaired following a prolonged period of use when, for example, the material with the lowest resistance to deformation has, after significant stressing, weakened its characteristics with respect to damping and pressure distribution.

The invention is not limited to the examples already described and illustrated since various modifications may be brought about without departing from the context of the invention.

What is claimed is:

1. A body support device adaptable on a wheelchair having a chassis supporting an upright articulated structure including a seat, a back portion and a foot rest, said body support device comprising:

a pair of stockings, wherein each of said pair of stockings comprises a cradle having a generally concave surface for nesting legs of a user therewithin, a support comprising a frontal arm, each of said stocking cradles being mounted on said support, said support being articulated on a lateral pivot with vertical orientation adapted on said foot rest, and a locking device linking said pair of stockings.

2. The device according to claim 1, further comprising an assembly sleeve on said frontal arm, wherein said frontal arm is linked to the vertical pivot by a lateral portion, and wherein each of said stocking cradle is adjustably mounted on said assembly sleeve.

3. The device according to claim 1, wherein each of said stocking cradle further comprises a resistant reinforcement buried in a coating made of a material permitting an elastic deformation with a damping and pressure distribution function.

4. The device according to claim 3, wherein each resistant reinforcement comprises a blade made of a rigid material selected from those able to permit permanent winding/unwinding deformation.

5. The device according to claim 3, wherein the coating comprises two constituents able to resist various deformations, the constituent with the lowest resistance contributing in defining the concave surface for nesting the leg.

6. The device according to claim 5, wherein the coating is covered with a contact skin.

7. The device according to claim 5, wherein the face of the coating defining the concave surface for nesting the leg comprises an open housing for adapting a ductile bearing comprising the constituent with the lowest resistance.

8. The device according to claim 7, wherein the bearing is mounted in the housing by removable fixing means.

9. The device according to claim 7, wherein the bearing forms blocks or anti-bed sore stoppers.

10. The device according to claims 7, wherein the bearing comprises a casing containing a gel.

11. A stand-up lifting wheelchair for handicapped persons having a body support device, a chassis supporting an upright articulated structure including a seat, a back portion and a foot rest, said body support device comprising:

a pair of stockings, wherein each of said pair of stockings comprises a cradle having a generally concave surface for nesting legs of a user therewithin, a support comprising a frontal arm, each of said stocking cradles being mounted on said support, said support being articulated on a lateral pivot with vertical orientation adapted on said foot rest, and a locking device linking said pair of stockings.

12. The wheelchair according to claim 11 wherein each cradle is mounted adjustable by an assembling sleeve on the frontal arm which is linked to the vertical pivot arm by a lateral portion.

13. The wheelchair according to claim 11, wherein each cradle comprises a resistant reinforcement buried in a coating made of a material permitting an elastic deformation with a damping and pressure distribution function.

14. The wheelchair according to claim 13, wherein each resistant reinforcement comprises a blade made of a rigid material selected from those able to permit permanent winding/unwinding deformation.

15. The wheelchair according to claim 13, wherein the coating comprises two constituents able to resist various deformations, the constituent with the lowest resistance contributing in defining the concave surface for nesting the leg.

16. The wheelchair according to claim 15, wherein the coating is covered with a contact skin.

17. The wheelchair according to claim 15, wherein the face of the coating defining the concave surface for nesting the leg comprises an open housing for adapting a ductile bearing comprising the constituent with the lowest resistance.

18. The wheelchair according to claim 17, wherein the bearing is mounted in the housing by removable fixing means.

19. The wheelchair according to claim 17, wherein the bearing forms blocks or anti-bed sore stoppers.

20. The wheelchair according to claims 17, wherein the bearing comprises a casing containing a gel.

* * * * *